US007469787B2

(12) United States Patent
Yuhara

(10) Patent No.: US 7,469,787 B2
(45) **Date of Patent: *Dec. 30, 2008**

(54) COSMETIC CONTAINER

(75) Inventor: Yukitomo Yuhara, Abiko (JP)

(73) Assignee: Yoshida Industry Co., Ltd., Tokyo (JP)

( * ) Notice: Subject to any disclaimer, the term of this patent is extended or adjusted under 35 U.S.C. 154(b) by 402 days.

This patent is subject to a terminal disclaimer.

(21) Appl. No.: 10/670,770

(22) Filed: Sep. 26, 2003

(65) Prior Publication Data

US 2005/0115863 A1 Jun. 2, 2005

(30) Foreign Application Priority Data

Sep. 26, 2002 (JP) ..... 2002-280340
Jan. 22, 2003 (JP) ..... 2003-013743

(51) Int. Cl.
*B65D 69/00* (2006.01)
*A45D 33/00* (2006.01)

(52) U.S. Cl. ..... 206/581; 206/235; 206/823; 132/293

(58) Field of Classification Search ..... 206/581, 206/823, 235, 1.5; 220/255; 132/293, 296, 132/300, 301

See application file for complete search history.

(56) References Cited

U.S. PATENT DOCUMENTS 4,483,355 A * 11/1984 Yuhara ..... 132/301
4,696,317 A * 9/1987 Shioi et al. ..... 132/314
4,972,860 A * 11/1990 Yuhara et al. ..... 132/301
5,022,529 A * 6/1991 Kang ..... 206/581
5,050,623 A * 9/1991 Yuhara et al. ..... 132/301
5,115,930 A * 5/1992 Lohrman et al. ..... 215/227
5,199,451 A * 4/1993 Montoli ..... 132/315
5,363,969 A * 11/1994 Shen ..... 206/581
5,878,878 A * 3/1999 Wu ..... 206/307
6,283,129 B1 * 9/2001 Yuhara et al. ..... 132/295
6,354,308 B1 * 3/2002 Kuk ..... 132/301

FOREIGN PATENT DOCUMENTS

| | | |
|---|---|---|
| FR | 2784971 A1 | 4/2000 |
| JP | 2004-113416 A | 4/2004 |
| JP | 2004-135947 A | 5/2004 |
| JP | 2004-135948 A | 5/2004 |
| JP | 2004-154283 A | 6/2004 |
| JP | 2004-154284 | 6/2004 |

* cited by examiner

*Primary Examiner*—Mickey Yu
*Assistant Examiner*—Steven A. Reynolds
(74) *Attorney, Agent, or Firm*—Morrison & Foerster LLP

(57) ABSTRACT

A cosmetic container comprises a container section, a lid section for opening and closing the cosmetic container, and one or two replaceable covers detachably attached on, and replaceably covering, one or both of the lid section and the container section. The cosmetic container thus structured can satisfy the demand that the decorative part should not even partially peel off or come off of the container section or lid section, and can give the user greater freedom of choice in the selection of its outer appearance.

1 Claim, 14 Drawing Sheets

COSMETIC CONTAINER

CROSS REFERENCE TO RELATED APPLICATION

This application claims the priority of Japanese Patent Application Nos. 2002-280340 filed on Sep. 26, 2002, and 2003-13743 filed on Jan. 22, 2003, which are incorporated herein by reference.

FIELD OF THE INVENTION

The present invention relates to a cosmetic container that can satisfy the demand that a decorative part should not even partially peel off or come off of a container section or lid section, and that can give the user greater freedom of choice in the selection of its outer appearance.

DESCRIPTION OF THE RELATED ART

Generally, a cosmetic container comprises a container section for storing cosmetics, and a lid section for opening and closing the container. These container section and lid section forming the outer appearance of the cosmetic container have been heretofore decorated by various methods for an aesthetically more pleasing appearance. The container section and lid section have been decorated, for example, by a surface treatment such as spattering, by transferring letters or patterns using transfer paper, or by adding a transparent or semitransparent layer over affixed patterns.

The present applicant has filed the following related applications, Japanese Patent Application Nos. 2001-49000, 2002-280340, 2002-304682, 2002-304683, 2002-321873 and 2002-321874.

In the manufacture of conventional cosmetic containers, there has been the demand that, to produce high quality, aesthetically pleasing cosmetic containers, a decorative part should be formed undetachably integrally in the container section or lid section by any of the above decorating methods so that the decorative part may not partially peel off or come off of the container section or lid section.

However, this demand means that the appearances of the cosmetic containers are limited to the designs originally affixed by a manufacturer, thereby preventing a user from freely selecting the decorative appearance of the cosmetic container to her taste. Thus, a user has to settle for a less desirable design, which may have accounted for sluggish sales.

SUMMARY OF THE INVENTION

The present invention has been made in view of the above problem, and it is accordingly one of the objects of the present invention to provide a cosmetic container that can satisfy the demand that a decorative part should not even partially peel off or come off of a container section or lid section, and that can give the user greater freedom of choice in the selection of its outer appearance.

In order to attain the foregoing and other objects, a cosmetic container according to a preferred embodiment of the present invention comprises a container section, a lid section for opening and closing the cosmetic container, and one or two replaceable covers detachably attached on, and replaceably covering, one or both of the lid section and the container section.

Hence, the cosmetic container of this preferred embodiment can satisfy the demand that the decorative part should not even partially peel off or come off of the container section or lid section, and can give a user greater freedom of choice in the selection of its outer appearance.

Further, a cosmetic container according to another preferred embodiment of the present invention is provided with engaging mechanisms which are formed between the replaceable cover and the lid section or between the replaceable cover and the container section such that these are releasably engaged with each other.

Hence, the cosmetic container of this preferred embodiment makes it possible for the replaceable cover to be easily replaced by the engagement and disengagement of the engaging mechanisms.

Further, a cosmetic container according to another preferred embodiment of the present invention comprises a resiliently deformable bending piece formed on either the replaceable cover or one of the container section and the lid section, and the engaging mechanism comprises an engaging member formed on the bending piece, and a coacting member formed on the other, namely either the replaceable cover or one of the container section and the lid section that remains, and adapted to releasably engage the engaging member.

Thus, the cosmetic container of this preferred embodiment can achieve enhanced ease of manipulation for the engagement and disengagement of the engaging mechanisms.

Further, a cosmetic container according to another preferred embodiment of the present invention comprises a hinge and a latch mechanism disposed at both ends of the container between the container section and the lid section, the hinge joining the container section and the lid section such that these can pivot on the hinge, the latch mechanism retaining a closed state in which the lid section is closed over the container section. The engaging mechanisms are provided adjacent to the latch mechanism and the hinge, respectively.

In the cosmetic container of this embodiment, the spaces for providing the latch mechanism and the hinge can be utilized economically to provide the engaging mechanisms.

Further, a cosmetic container according to another preferred embodiment of the present invention comprises a container section, a lid section for opening and closing the cosmetic container, a replaceable cover replaceably attached on, and covering, the lid section, a through-hole formed in the lid section so as to extend toward the replaceable cover, an engaging member formed in the through-hole, a handle formed in the replaceable cover and extending through the through-hole to be exposed in the lid section, and a coacting member formed on the handle and releasably engaging the engaging member.

Hence, the cosmetic container of this embodiment can satisfy the demand that its decorative part should not even partially peel off or come off of the container section or lid section, and can give the user greater freedom of choice in the selection of its outer appearance.

Further, a cosmetic container according to another preferred embodiment of the present invention is characterized in that the replaceable cover is provided to cover the upper surface of the lid section, a hinge element which is formed on the lid section and in which the through-hole is formed is pivotally joined to the container section so as to open and close the cosmetic container, and the handle is exposed in the undersurface of the lid section opposite the upper surface.

In the cosmetic container of this embodiment, the hinge element is utilized to provide the space in which the through-hole and engaging member are formed for mounting the replaceable cover on the lid section, without enlarging the outer dimensions of the cosmetic container. Additionally, in the hinge element, the handle is exposed in the undersurface of the lid section, which renders the cosmetic container aesthetically pleasing in its overall appearance.

Further, a cosmetic container according to another preferred embodiment of the present invention comprises a container section, a lid section for opening and closing the cosmetic container, and one or two replaceable covers replaceably attached on, and covering, one or both of the lid section and the container section, a recess formed on the outer surface (of each) of the lid section and/or the container section, an engaging member formed in the recess, a resiliently deformable handle formed on the replaceable cover and concealing the recess, and a coacting member formed on the handle to releasably engage the engaging member and adapted to be disengaged from the engaging member by the resilient deformation of the handle.

Thus, the cosmetic container of this embodiment can satisfy the demand that the decorative part should not even partially peel off or come off of the container section or lid section, and can give the user greater freedom of choice in the selection of its outer appearance. Further, the structure that the recess for the engagement between the engaging member and coacting member is concealed by the handle renders the outer appearance of the cosmetic container aesthetically pleasing.

BRIEF DESCRIPTION OF THE DRAWINGS

The above and other objects, features and other advantages of the present invention will be more clearly understood from the following detailed description of the preferred embodiments, taken in conjunction with the accompanying drawings, in which.

DESCRIPTION OF THE PREFERRED EMBODIMENTS

Figure 1:
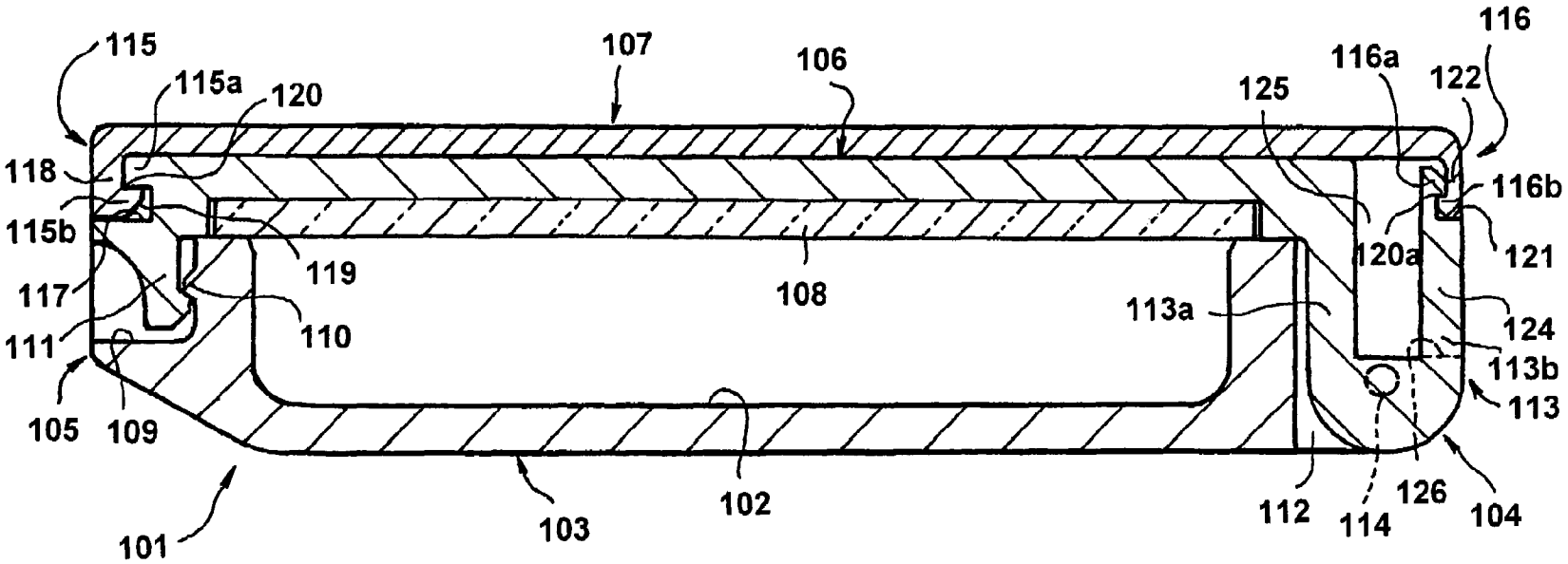
FIG. 1 is a side sectional view of a cosmetic container in accordance with a first preferred embodiment of the present invention.
Figure 2:
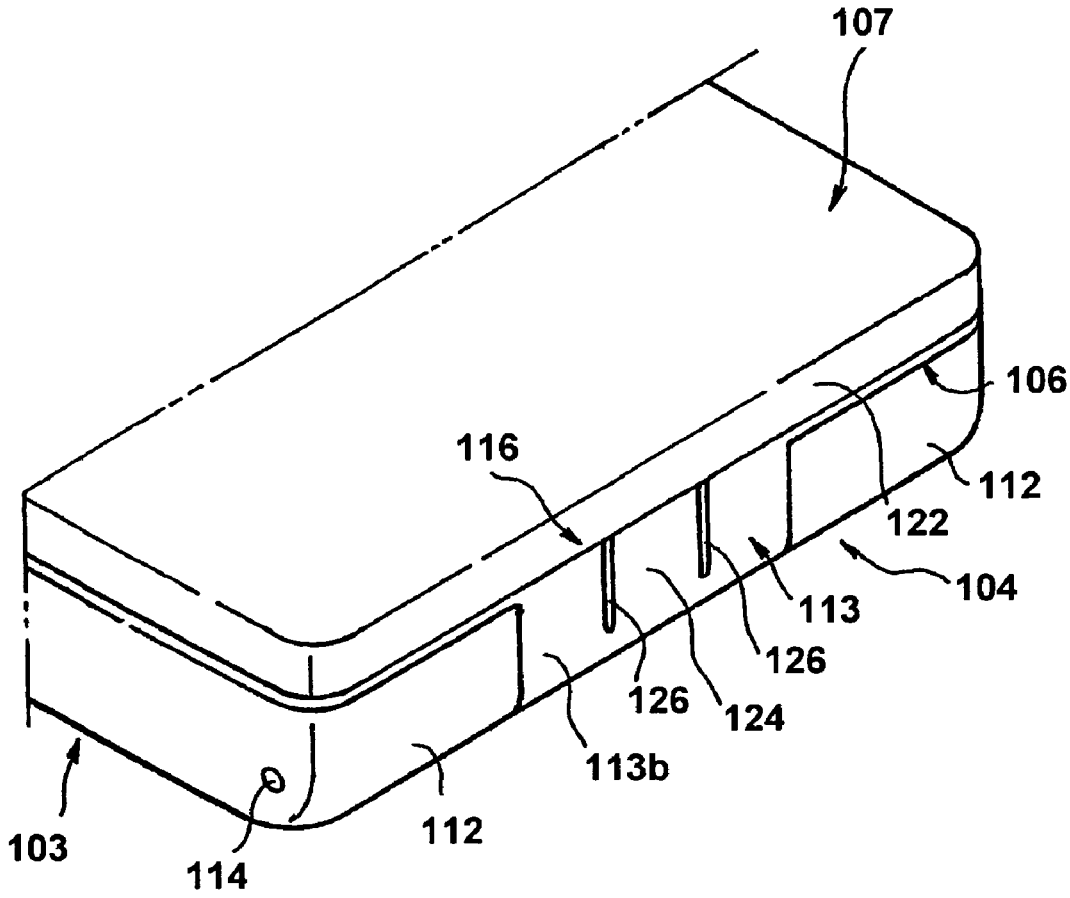
FIG. 2 is a fragmentary enlarged perspective view of the hinge part of the cosmetic container of FIG. 1.
Figure 3:
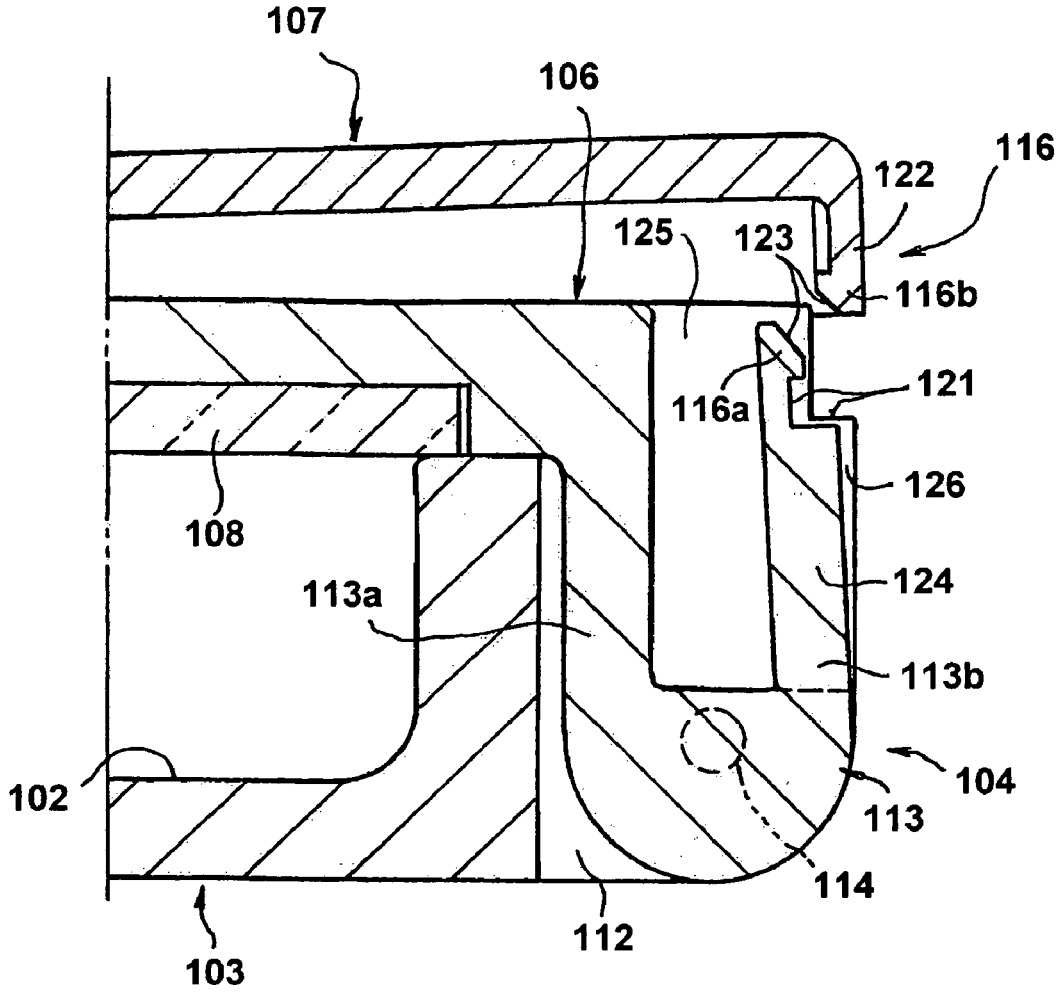
FIG. 3 is a fragmentary enlarged sectional view of the hinge part of the cosmetic container of FIG. 1, showing the process of detaching a replaceable cover.
Figure 4:
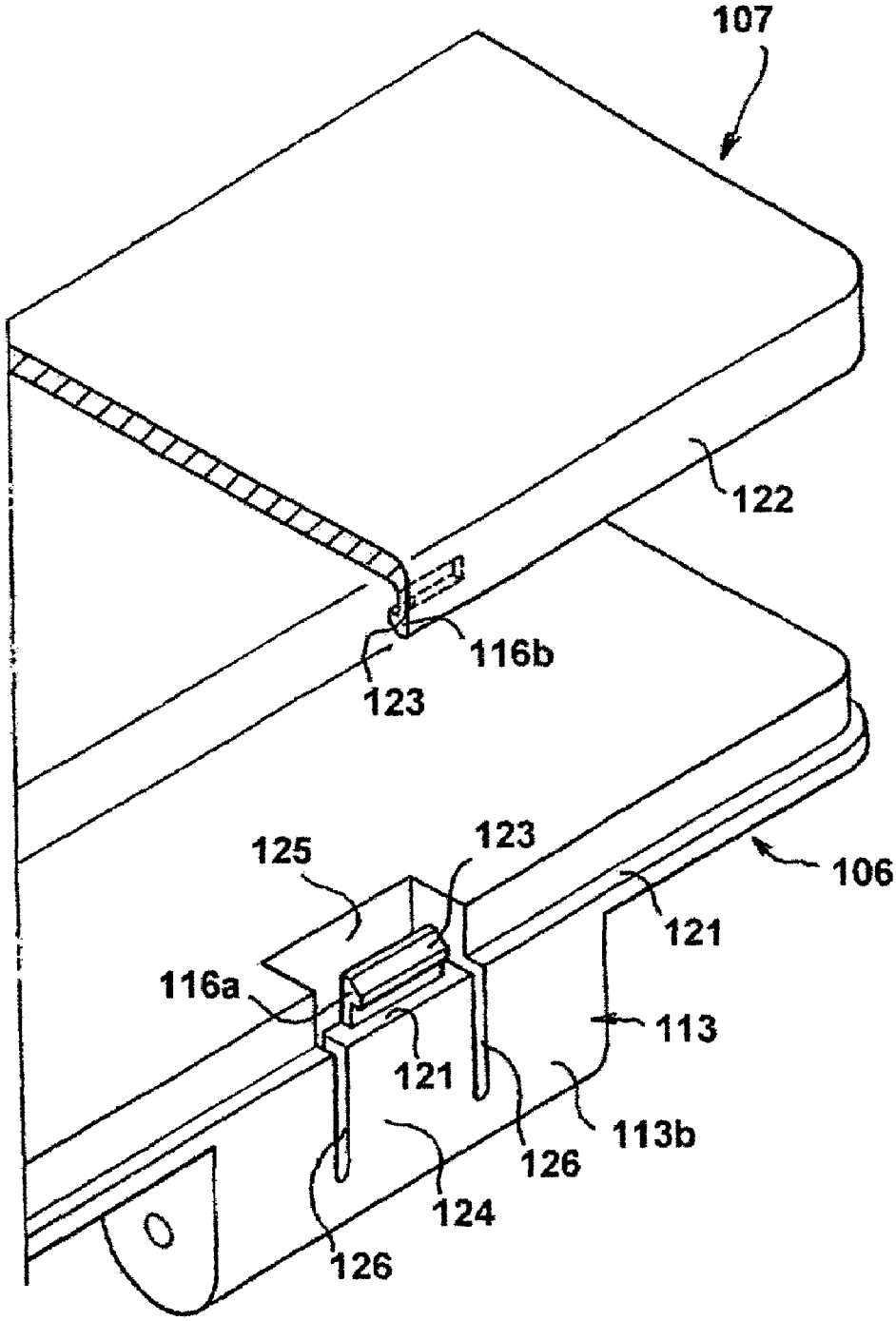
FIG. 4 is a fragmentary enlarged perspective view of the hinge part of the cosmetic container of FIG. 1, showing the process of detaching the replaceable cover.

Preferred embodiments of a cosmetic container in accordance with the present invention will now be described below in detail with reference to the accompanying drawings.

First Preferred Embodiment

A first preferred embodiment of a cosmetic container in accordance with the present invention will be described below in detail with reference to the accompanying drawings. As shown in FIGS. 1 through 4, the cosmetic container 101 of the first preferred embodiment generally comprises a dish-like synthetic resin container section 103 provided with a storage recess 102, a plate-like synthetic resin lid section 106 pivoted on a hinge 104 at one end of the container section 103 for vertical rotation for opening and closing the container, and releasably engaging the other end of the container section 103 via a latch mechanism 105 so as to retain the cosmetic container 101 in a closed state, and a plate-like synthetic resin replaceable cover 107 detachably attached at least on either of the lid section 106 or the container section 103 (in this embodiment, one replaceable cover is attached on the lid section 106) so as to replaceably cover the lid section 106.

Alternatively, the replaceable cover 107 may be attached on the container section 103, or both the lid section 106 and the container section 103 may be provided with a replaceable cover. Although the container section 103, lid section 106 and replaceable cover 107 are all rectangular in plan view in these drawings, they may be polygonal or circular. A mirror 108 is attached on the undersurface of the lid section 106.

The latch mechanism 105 comprises a hook boss 110 projecting from a recess 109 formed at the end of the container section 103, and a hook element 111 extending downwardly from the end of the lid section 106 and adapted to releasably engage the hook boss 110. On the opposite side of the container from the latch mechanism 105, the hinge 104 comprises a pair of hinge pieces 112 projecting from the end of the container section 103, a hinge block 113 extending downwardly from the end of the lid section 106 between the hinge pieces, and a hinge pin 114 inserted through the hinge block 113 and hinge pieces 112.

The replaceable covers 107 include a decorative portion so as to be available in a great number of types of decoration, and therefore the decorative appearance of the cosmetic container 101 or the lid section 106 in this embodiment can be freely changed as desired by the user. The decorative portion is undetachably integrally formed with the replaceable cover 107 by well-known methods so as not to even partially peel off or come off of the replaceable cover 107. These replaceable covers 107 all have substantially equal outside dimensions so that their contours match the contours of the container section 103, while the lid section 106, on which the replaceable cover 107 is attached, has slightly smaller outside dimensions than the replaceable cover 107 because the space for a structure enabling the attachment needs to be allowed for. The replaceable cover 107 is placed on top of the lid section 106. The material for the replaceable cover 107 is not limited to synthetic resin, and it may be made of metal material.

A first engaging mechanism 115 and a second engaging mechanism 116 are provided between the replaceable cover 107 and the lid section 106 such that these are releasably engaged with each other. These engaging mechanisms 115, 116 are provided adjacent to the latch mechanism 105 and the hinge 104 respectively, disposed at the opposite ends of the lid section 106. The parts of the lid section 106 adjacent to the latch mechanism 105 and the hinge 104 are enlarged toward the container section 103 such that larger spaces may be provided in these parts than in the main portion of the lid section 106. The first engaging mechanism 115 adjacent to the latch mechanism 105 comprises a first engaging member 115*a* on the lid section 106, and a first coacting member 115*b* on the replaceable cover 107. The first engaging member 115*a* projects over part of a recess 117 which is formed by offsetting, toward the hinge 104, the entire side of the lid section 106 adjacent to the hook element 111. The entire width of the replaceable cover 107 adjacent to the first engaging member 115*a* ends in a bent, downward extension 118 from which the first coacting member 115*b* corresponding to the first engaging member 115*a* projects into the recess 117 under the first engaging member 115*a*.

When the replaceable cover 107 is fitted onto the lid section 106, the first coacting member 115*b* is pushed over the first engaging member 115*a* into the recess 117 below so that these members are releasably engaged with each other. It should be noted that the wall 119 of the first coacting member 115*b* that, during the pushing process, comes into contact with the first engaging member 115*a* is tapered to help the first coacting member to go smoothly over the first engaging member, while the corners 120 of the first engaging member 115*a* and the first coacting member 115*b* that, when these members are in engagement, abut on each other are angular so that these members may not easily come out of engagement.

Like the first engaging mechanism 115, the second engaging mechanism 116 adjacent to the hinge 104 also comprises a second engaging member 116*a* on the lid section 106, and a second coacting member 116*b* on the replaceable cover 107. The second engaging member 116*a* projects over part of a recess 121 which is formed by offsetting, toward the latch mechanism 105, the entire side of the lid section 106, having the hinge block 113, on the other side of the container from the latch mechanism. The entire width of the replaceable cover 107 adjacent to the second engaging member 116*a* ends in a bent, downward extension 122 from which the second coacting member 116*b* corresponding to the second engaging member 116*a* projects into the recess 121 under the second engaging member 116*a*. Also, when the replaceable cover 107 is fitted onto the lid section 106, the second coacting member 116*b* is pushed over the second engaging member 116*a* into the recess 121 below so that these members are releasably engaged with each other. As for the second engaging mechanism 116, the walls 123 of the second engaging member 116*a* and the second coacting member 116*b* that, during the pushing process, come into contact with each other, are tapered to help the second coacting member to go smoothly over the second engaging member, while the corners 120*a* of the second engaging member 116*a* and the second coacting member 116*b* that, when these members are in engagement, abut on each other are angular so that these members may not easily come out of engagement.

Additionally in this embodiment, a resiliently deformable bending piece 124 is formed on the hinge block 113 of the lid section 106, and the second engaging member 116*a* is formed on this bending piece 124. Referring to the drawings, the hinge block 113 is provided with a cutout 125 that divides the hinge block into two parts, namely an inner wall portion 113*a* disposed closer to the latch mechanism 105 and an outer wall portion 113*b* having the second engaging member 116*a*. Provided in this outer wall portion 113*b* are a pair of straight slits 126, each on either side of the second engaging member 116*a*, which extend from the recess 121 toward the lower end of the hinge block 113, and are continuous with the cutout 125, and thus between these slits 126, the resiliently deformable bending piece 124 is formed which has resilience relative to the outer wall portion 113*b* because of its free upper end and its lower end joined to the outer wall portion 113*b*.

Therefore, when the second coacting member 116*b* is pushed over the second engaging member 116*a* for engagement at the second engaging mechanism 116, the bending piece 124 is resiliently deformed to move the second engaging member 116*a* toward the cutout 125. On the other hand, when the bending piece 124 is pushed and resiliently deformed toward the cutout 125 in order to effect disengagement of these members, the second engaging member 116*a* is moved toward the cutout 125 and disengaged from the second coacting member 116*b*. Needless to say, the direction in which the second engaging member 116*a* and second coacting member 116*b* engage may be reversed, the bending piece 124 may be provided on the replaceable cover 107, and the second coacting member 116*b* may be provided on the bending piece 124.

In operation of the cosmetic container 101 of the present invention, when a user wishes to replace the replaceable cover 107 fitted on the lid section 106 with a new replaceable cover 107 of another design, the bending piece 124 is resiliently deformed by the finger, etc., to cause the second engaging member 116*a* to disengage from the second coacting member 116*b*, and then the replaceable cover 107 can be simply raised up from the lid section 106. When the replaceable cover 107 is detached from the lid section 106 in this way by disengaging the second engaging mechanism 116, the first engaging member 115*a* and first coacting member 115*b* of the first engaging mechanism 115 can be disengaged from each other, and thus the replaceable cover 107 can be detached from the lid section 106. Next, in order to attach a new replaceable cover 107 on the lid section 106, the side of the replaceable cover 107 where the second engaging member 116 is disposed is pushed onto the lid section 106 with the first engaging mechanism 115 being in engagement, which causes the bending piece 124 to be resiliently deformed. This deformation causes the second coacting member 116*b* to engage the second engaging member 116*a*, and thus a new replaceable cover 107 can be attached on the lid section 106.

As described above, in the cosmetic container 101 according to the first preferred embodiment of the present invention, since the replaceable cover 107 is detachably attached on, and replaceably covers, the lid section 106, a user can freely change the external decorative appearance of the cosmetic container 101 originally affixed by a manufacturer to a preferable one, which can arouse consumer interest for sales increase. Further, since the decorative part may be undetachably, integrally formed with the replaceable cover 107 in the same manner as conventional lid sections, it is not possible that the decorative part even partially peels off or come off of the replaceable cover 107, so the cosmetic container 101 according to the present invention can stand comparison, in quality and upscale appearance, with conventional ones.

Further, the first engaging mechanism 115 and second engaging mechanism 116 are provided between the replaceable cover 107 and lid section 106 as the means for the releasable engagement between these, so the replaceable cover 107 can be replaced easily by the engagement and disengagement of these engaging mechanisms 115, 116. Furthermore, since the lid section 106 is provided with the resiliently deformable bending piece 124, and the second engaging mechanism 116 comprises the second engaging member 116*a* formed on the bending piece 124 and the second coacting member 116*b* formed on the replaceable cover 107, the resilient deformation of the bending piece 124 can be used to achieve enhanced ease of use for the engagement and disengagement of the second engaging mechanism 116. Furthermore, since the first engaging mechanism 115 and the second engaging mechanism 116 are provided adjacent to the latch mechanism 105 and the hinge 104 respectively, the enlargement toward the container section 103 in which the latch mechanism 105 and hinge 104 are formed can be utilized economically to provide these engaging mechanisms 115, 116. Since the part of the bending piece 124 that is fingered for replacement is visible from outside of the cosmetic container 101, it is easy to learn where to place a finger for replacement.

Figure 5:
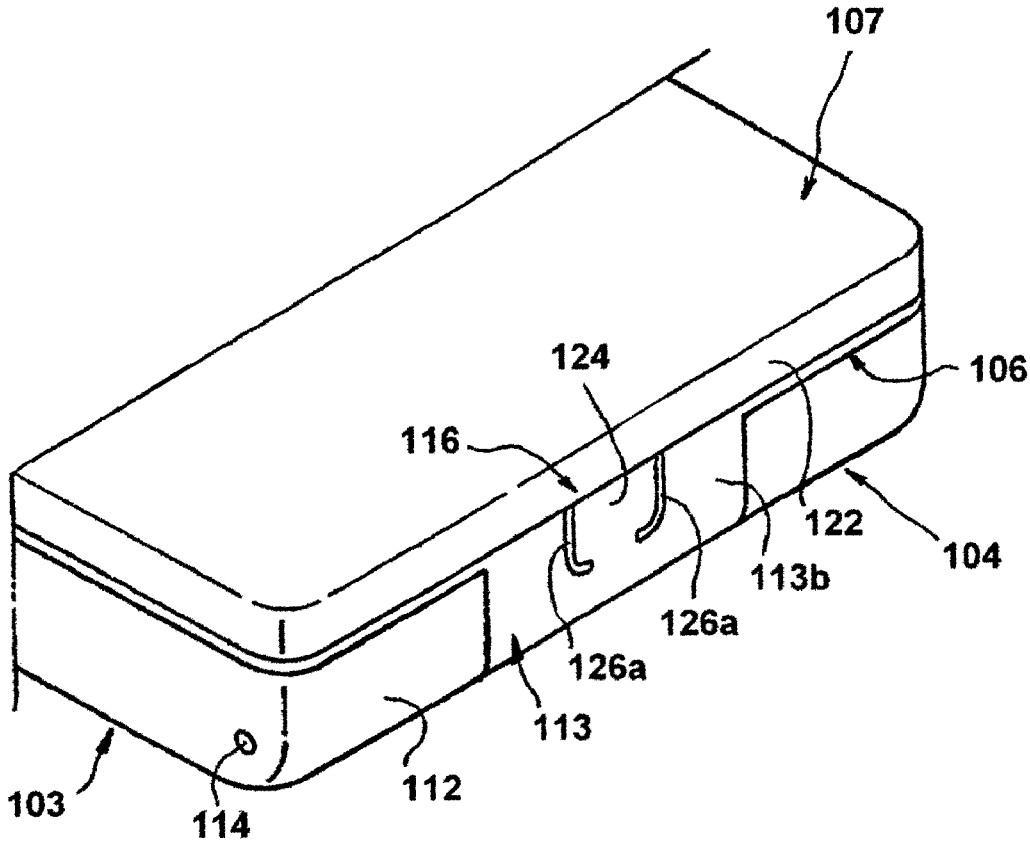
FIG. 5 is a fragmentary enlarged perspective view of the hinge part of a variant of the cosmetic container in accordance with the first preferred embodiment of the present invention.

FIG. 5 shows a variant of the above embodiment. In this variant, in order to impart less resilience to the bending piece 124, a pair of slits 126*a* are formed such that the lower ends come closer to each other in a substantial U-shape. Needless to say, this variant has the same effects as the above embodiment.

Although the above description has been given about the first preferred embodiment of the structure in which the replaceable cover 107 is detachably attached on, and replaceably covers, the lid section 106, if the replaceable cover 107 is to be attached on the container section 103, an engaging mechanism is provided between the container section 103 and the replaceable cover 107 such that these may releasably engage each other, in which case the bending piece 124 and engaging members may be provided on either one of the container section 103 or the replaceable cover 107, and the coacting members may be provided on the other. Further, also in the case where the replaceable cover 107 is attached on the container section 103, the engaging mechanisms may be provided adjacent to the hinge 104 and latch mechanism 105. Further, although the invention has been described about the preferred embodiment of the structure in which the cosmetic container 101 is provided with the hinge 104 and latch mechanism 105, it is not limited, needless to say, to this structure, and may be applied to various containers in which the lid section 106 is detachably attached on the container section 103 by a threaded structure or radial engagement structure.

Second Preferred Embodiment

A second preferred embodiment of a cosmetic container in accordance with the present invention will be described below in detail with reference to the accompanying drawings. As shown in FIGS. 6 through 9, the cosmetic container 201 of the second preferred embodiment generally comprises a dish-like synthetic resin container section 203 provided with a storage recess 202, a plate-like synthetic resin lid section 206 pivoted on a hinge 204 at one end of the container section 203 for vertical rotation for opening and closing the container, and releasably engaging the other end of the container section 203 via a latch mechanism 205 so as to retain the cosmetic container 201 in a closed state, and a plate-like synthetic resin replaceable cover 207 detachably attached on the lid section 206 so as to replaceably cover the upper surface 206*a* of the lid section 206.

Although the container section 203, lid section 206 and replaceable cover 207 are all rectangular in plan view in these drawings, they may be polygonal or circular. A mirror 208 is attached on the undersurface 206*b* of the lid section 206.

The latch mechanism 205 comprises a hook boss 210 projecting from a recess 209 formed at the end of the container section 203, and a hook element 211 extending downwardly from the end of the lid section 206 and adapted to releasably engage the hook boss 210. On the opposite side of the container from the latch mechanism 205, the hinge 204 comprises a pair of hinge pieces 212 projecting from the end of the container section 203, a hinge block 213 extending downwardly from the end of the lid section 206 between the hinge pieces, and a hinge pin (not shown) inserted through a pin hole 214 formed through the hinge block 213 and hinge pieces 212, and the hinge block 213 is rotatably attached to the container section 203 by the hinge pieces 212 and hinge pin.

The replaceable covers 207 include a decorative portion so as to be available in a great number of types of decoration, and therefore the decorative appearance of the cosmetic container 201 or the lid section 206 in this embodiment can be freely changed as desired by the user. The decorative portion is undetachably integrally formed with the replaceable cover 207 by well-known methods so as not to even partially peel off or come off of the replaceable cover 207.

These replaceable covers 207 all have substantially equal outside dimensions so that their contours match the contours of the container section 203, while the lid section 206, on which the replaceable cover 207 is attached, has slightly smaller outside dimensions than the replaceable cover 207 because the space for a structure enabling the attachment needs to be allowed for. The replaceable cover 207 is placed on top of the lid section 206. The material for the replaceable cover 207 is not limited to synthetic resin, and it may be made of metal material.

A first engaging mechanism 215 and a second engaging mechanism 216 are provided between the replaceable cover 207 and the lid section 206 such that these are releasably engaged with each other. These engaging mechanisms 215, 216 are provided adjacent to the latch mechanism 205 and the hinge 204 respectively, disposed at the opposite ends of the lid section 206. The parts of the lid section 206 adjacent to the latch mechanism 205 and the hinge 204 are enlarged toward the container section 203 such that larger spaces may be provided in these parts than in the main portion of the lid section 206. The first engaging mechanism 215 adjacent to the latch mechanism 205 comprises a first engaging member 215*a* on the lid section 206, and a first coacting member 215*b* on the replaceable cover 207.

The first engaging member 215*a* projects over part of a recess 217 which is formed by offsetting, toward the hinge 204, the entire side of the lid section 206 adjacent to the hook element 211. The entire width of the replaceable cover 207 adjacent to the first engaging member 215*a* ends in a bent, downward extension 218 from which the first coacting member 215*b* corresponding to the first engaging member 215*a* projects into the recess 217 under the first engaging member 215*a*.

When the replaceable cover 207 is fitted onto the lid section 206, the first coacting member 215*b* is pushed over the first engaging member 215*a* into the recess 217 below so that these members are releasably engaged with each other. It should be noted that the wall 219 of the first coacting member 215*b* that, during the pushing process, comes into contact with the first engaging member 215*a* is tapered to help the first coacting member to go smoothly over the first engaging member, while the corners 220 of the first engaging member 215*a* and the first coacting member 215*b* that, when these members are in engagement, abut on each other are angular so that these members may not easily come out of engagement.

Figure 6:
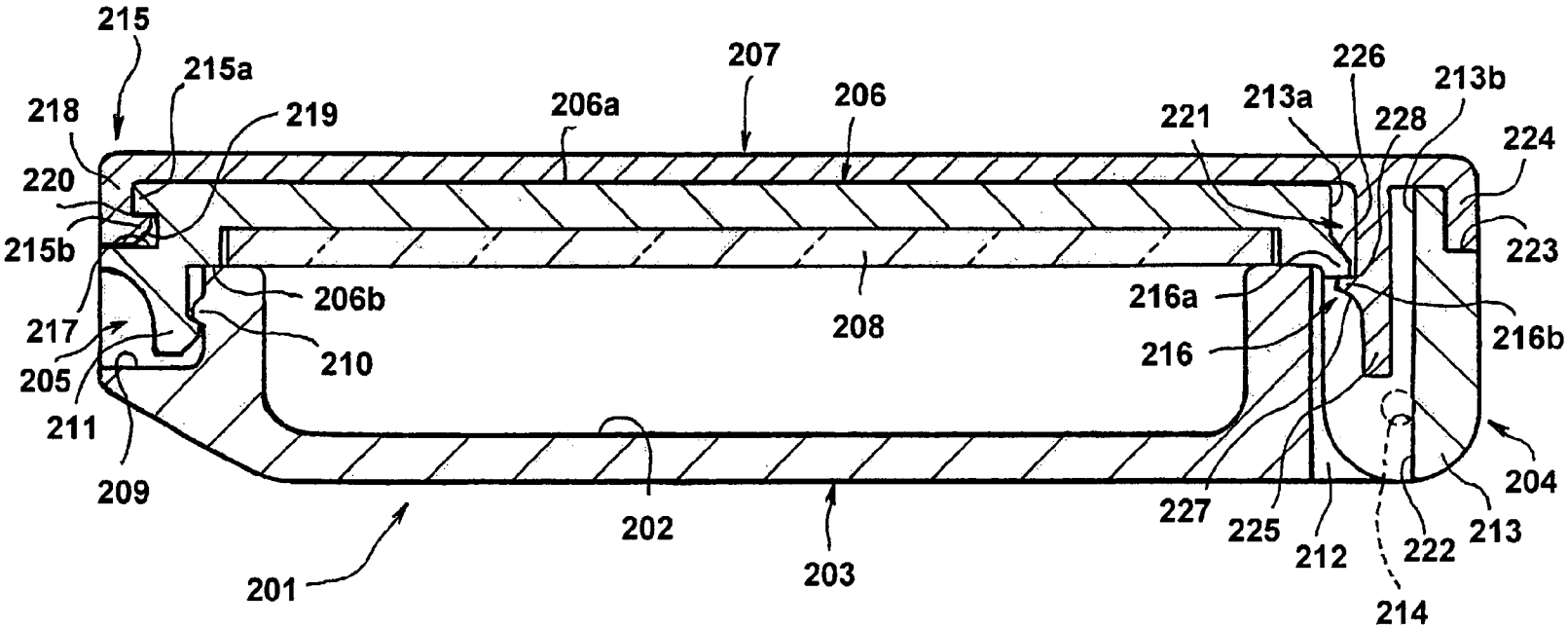
FIG. 6 is a side sectional view of a cosmetic container in accordance with a second preferred embodiment of the present invention.
Figure 7:
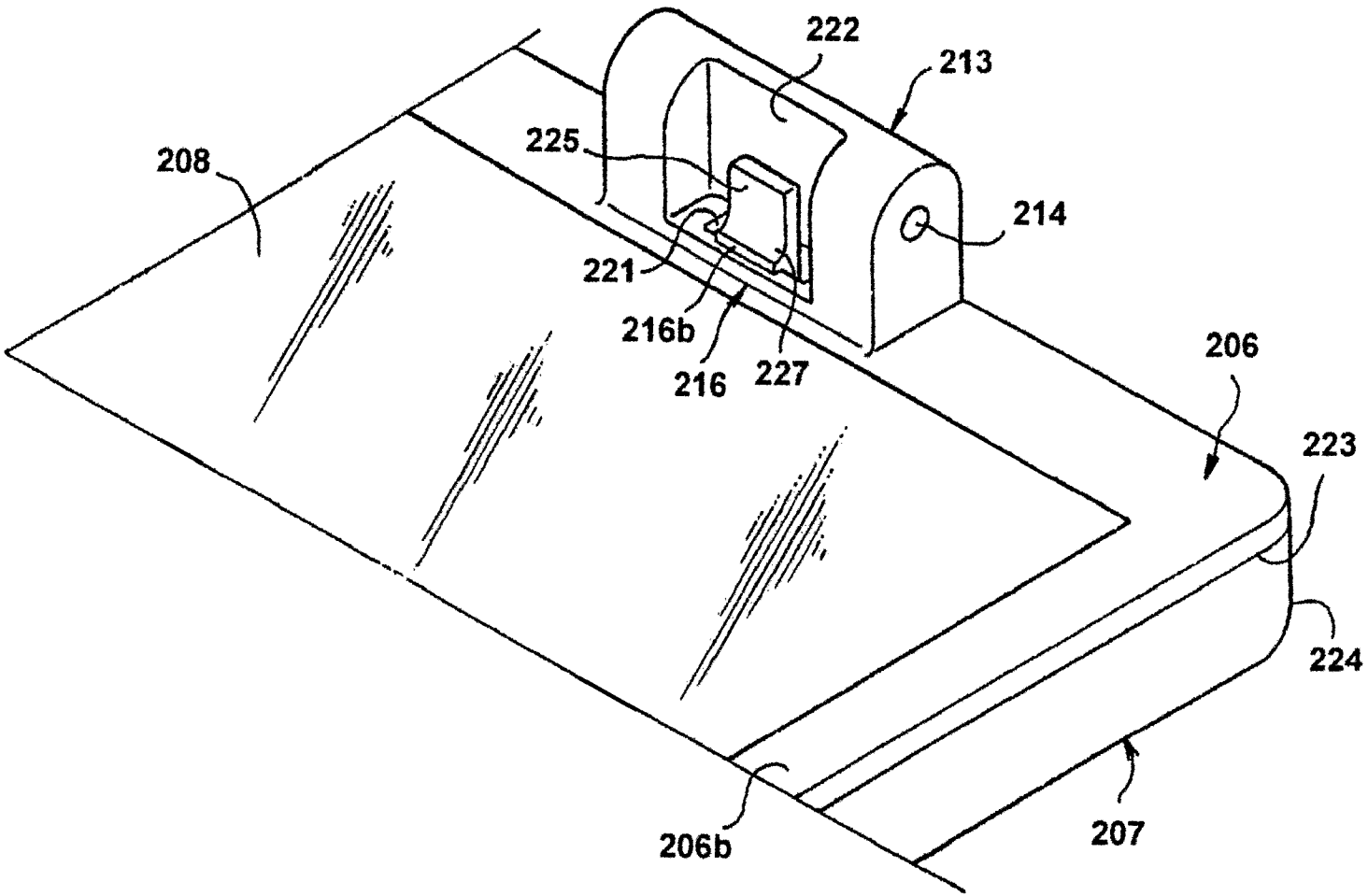
FIG. 7 is a fragmentary enlarged perspective view of the cosmetic container of FIG. 6 with the lid section in an open state.

Like the first engaging mechanism 215, the second engaging mechanism 216 adjacent to the hinge 204 also comprises a second engaging member 216*a* on the lid section 206, and a second coacting member 216*b* on the replaceable cover 207. As shown in FIGS. 6 and 7, the hinge block 213 has a through-hole 221 extending vertically through the lid section 206 toward the replaceable cover 207 fitted on the lid section 206, the through-hole 221 being defined by a partial inner wall portion 213*a* and a partial outer wall portion 213*b* of the lid section 206 and hinge block 213. Further, a dent 222 is formed on the side of the hinge block 213 facing the mirror 208, namely facing the undersurface 206*b* on the opposite side of the lid section 206 from the upper surface 206*a*, so as to surround the through-hole 221. The inner wall portion 213*a* is provided with the second engaging member 216*a*, which projects from the inner wall portion into the through-hole 221.

On the other hand, the entire width of the replaceable cover 207 adjacent to the hinge ends in a bent, downward extension 224 which extends toward the lid section 206 to be fitted into a ledge 223 formed over the entire width of the lid section 206 adjacent to the hinge. Formed interiorly of the downward extension 224 is a handle 225 which extends downwards through the through-hole 221 and the lid section 206 so as to be exposed in the dent 222. In this embodiment, the handle 225 extends downwards from the replaceable cover 207 by a length sufficient to be resiliently deformable. This handle 225 is provided with the second coacting member 216*b*, which projects toward the second engaging member 216*a* so as to releasably engage therewith.

When the replaceable cover 207 is fitted onto the lid section 206, the second coacting member 216*b* is pushed over the second engaging member 216*a* so that these members are releasably engaged with each other. As for the second engaging mechanism 216, the walls 226, 227 of the second engaging member 216*a* and the second coacting member 216*b* that, during the pushing process, come into contact with each other, are tapered to help the second coacting member to go smoothly over the second engaging member, while the corners 228 of the second engaging member 216*a* and the second coacting member 216*b* that, when these members are in engagement, abut on each other are angular so that these members may not easily come out of engagement.

Figure 8:
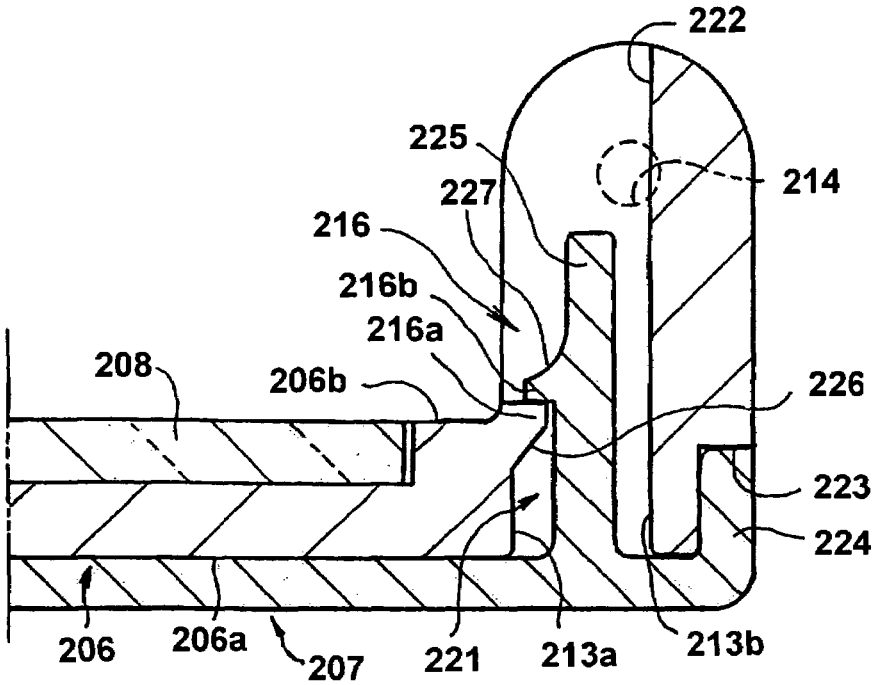
FIG. 8 is a fragmentary enlarged sectional view of the cosmetic container of FIG. 6 with the lid section in the open state.
Figure 9:
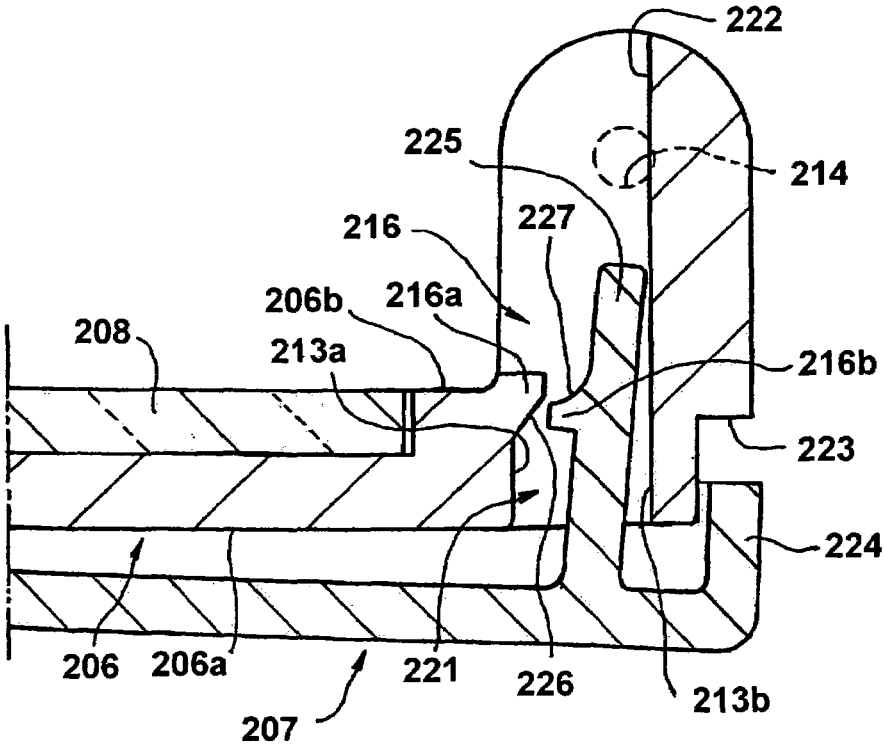
FIG. 9 is a fragmentary enlarged sectional view of the cosmetic container of FIG. 6 with the lid section in the open state, showing the process of mounting or detaching a replaceable cover.

In operation of the cosmetic container 201 of the present invention, when a user wishes to replace the replaceable cover 207 fitted on the lid section 206 with a new replaceable cover 207 of another design, the cosmetic container 201 is opened by the vertical rotation of the lid section 206 so that the hinge block 213 is exposed in the undersurface of the lid section, and, as shown in FIGS. 8 and 9, the handle 225, which is exposed in the dent 222, is then pushed toward the back of the dent.

When pushed, the handle 225 is resiliently deformed, thereby causing the second coacting member 216*b* to disengage from the second engaging member 216*a*, and then the replaceable cover 207 is pulled away from the lid section 206. When the replaceable cover 207 is detached in this way from the lid section 206 by the disengagement of the second engaging mechanism 216, the first engaging member 215*a* and the first coacting member 215*b* of the first engaging mechanism 215 can be disengaged from each other, and thus the replaceable cover 207 can be detached from the lid section 206.

Next, in order to mount a new replaceable cover 207 on the lid section 206, the side of the replaceable cover 207 where the second engaging mechanism 216 is disposed is pushed toward the lid section 206 with the first engaging mechanism 215 being in engagement, thereby causing the handle 225 to enter the through-hole 221. The resilient deformation of the handle causes the second coacting member 216*b* to engage the second engaging member 216*a*. Hence, the new replaceable cover 207 can be mounted on the lid section 206.

As described above, since the cosmetic container 201 according to the second preferred embodiment of the present invention is provided with the replaceable cover 207 attached on, and replaceably covering, the lid section 206, the through-hole 221 extending through the lid section 206 toward the replaceable cover 207, the second engaging member 216*a* formed inside the through-hole 221, the handle 225 extending from the replaceable cover 207 through the through-hole 221 so as to be exposed in the lid section 206, and the second coacting member 216*b*, formed on the handle 225, for releasably engaging the second engaging member 216*a*, a user can freely change the external decorative appearance of the cosmetic container 201 originally affixed by a manufacturer to a preferable one, which can arouse consumer interest for sales increase.

Further, since the decorative part may be undetachably, integrally formed with the replaceable cover 207 in the same manner as conventional lid sections, it is not possible that the decorative part even partially peels off or come off of the replaceable cover 207, so the cosmetic container 201 according to the present invention can stand comparison, in quality and upscale appearance, with conventional ones. Further, the first engaging mechanism 215 and second engaging mechanism 216 are provided between the replaceable cover 207 and lid section 206 for the releasable engagement between these, so the replaceable cover 207 can be replaced easily by the engagement and disengagement of these engaging mechanisms 215, 216.

Furthermore, in the second embodiment, the replaceable cover 207 is formed to cover the upper surface 206*a* of the lid section 206, which is provided with the hinge block 213, rotatably attached to the container section 203, for opening and closing the cosmetic container 201, the through-hole 221 is formed in the hinge block 213, and the handle 225 is exposed in the undersurface 206*b* on the other side of the lid section 206 opposite the upper surface 206*a*, so the hinge block 213 can be used as the space in which the through-hole 221 and second engaging member 216*a* are formed for mounting the replaceable cover 207 on the lid section 206 so that the space is economically used to provide the second engaging mechanism 216 without enlarging the outer dimensions of the cosmetic container 201, and the structure that the handle 225 in the hinge block 213 is exposed in the undersurface 206*b* of the lid section 206 renders the external appearance of the present cosmetic container 201 aesthetically pleasing not only when the lid section 206 is closed but also when it is opened.

Further, the handle 225 for the engagement and disengagement of the second coacting member 216*b* is resiliently deformable, which can achieve enhanced ease of use for the engagement and disengagement of the second engaging mechanism 216.

Although the invention has been described about the present embodiment of the structure in which the cosmetic container 201 is provided with the hinge 204 and latch mechanism 205, it is not limited, needless to say, to this structure, and may be applied to various containers in which the lid section 206 is detachably attached on the container section 203 by a threaded structure or radial engagement structure.

Third Preferred Embodiment

A third preferred embodiment of a cosmetic container in accordance with the present invention will be described below in detail with reference to the accompanying drawings. As shown in FIGS. 10 through 15, the cosmetic container 301 of the third preferred embodiment generally comprises a dish-like synthetic resin container section 303 provided with a storage recess 302, a plate-like synthetic resin lid section 306 pivoted on a hinge 304 at the longitudinally rear end of the container section 303 for vertical rotation for opening and closing the container, and releasably engaging the front end of the container section 303 via a latch mechanism 305 so as to retain the cosmetic container 301 in a closed state, and a plate-like synthetic resin replaceable cover 307 detachably attached on the lid section 306 so as to replaceably cover the outer surface 306*a* of the lid section 306.

The material for the replaceable cover 307 is not limited to synthetic resin, and it may be made of metal material. The replaceable cover 307 may be attached on the container section 303, or both the lid section 306 and the container section 303 may be provided with a replaceable cover. Although the container section 303, lid section 306 and replaceable cover 307 are all rectangular in plan view in these drawings, they may be polygonal or circular. A mirror 308 is attached on the undersurface 306*b* of the lid section 306.

The latch mechanism 305 comprises a hook boss 310 projecting from a recess 309 formed at the front end of the container section 303, and a hook element 311 extending downwardly from the front end of the lid section 306 and adapted to releasably engage the hook boss 310. On the opposite side of the container from the latch mechanism 305, the hinge 304 comprises a pair of hinge pieces 312 projecting from the rear end of the container section 303, a hinge block 313 extending downwardly from the rear end of the lid section 306 between the hinge pieces, and a hinge pin (not shown) inserted through a pin hole 314 formed through the hinge block 313 and hinge pieces 312, and the hinge block 313 is rotatable relative to the hinge pieces 312 via the hinge pin.

The replaceable covers 307 include a decorative portion so as to be available in a great number of types of decoration, and therefore the decorative appearance of the cosmetic container 301 or the lid section 306 in this embodiment can be freely changed as desired by the user. The decorative portion is undetachably integrally formed with the replaceable cover 307 by well-known methods so as not to even partially peel off or come off of the replaceable cover 307.

These replaceable covers 307 all have substantially equal outside dimensions so that their contours match the contours of the container section 303, while the lid section 306, on which the replaceable cover 307 is attached, has slightly smaller outside dimensions than the replaceable cover 307 because the space for a structure enabling the attachment needs to be allowed for. The replaceable cover 307 is placed on top of the lid section 306.

A first engaging mechanism 315 and a second engaging mechanism 316 are provided between the replaceable cover 307 and the lid section 306 such that these are releasably engaged with each other. These engaging mechanisms 315, 316 are provided adjacent to the latch mechanism 305 and the hinge 304 respectively, disposed at the longitudinally opposite ends of the lid section 306. The first engaging mechanism 315 adjacent to the latch mechanism 305 comprises a first engaging member 315*a* on the lid section 306, and a first coacting member 315*b* on the replaceable cover 307.

The first engaging member 315*a* projects over part of a recess 317 which is formed by offsetting, toward the hinge 304, the entire side of the lid section 306 adjacent to the hook element 311. The entire width of the replaceable cover 307 adjacent to the first engaging member 315*a* ends in a bent, downward extension 318 from which the first coacting member 315*b* corresponding to the first engaging member 315*a* projects into the recess 317 under the first engaging member 315*a*.

When the replaceable cover 307 is fitted onto the lid section 306, the first coacting member 315*b* is pushed over the first engaging member 315*a* into the recess 317 below so that these members are releasably engaged with each other. It should be noted that the wall 319 of the first coacting member 315*b* that, during the pushing process, comes into contact with the first engaging member 315*a* is tapered to help the first coacting member to go smoothly over the first engaging member, while the corners 320 of the first engaging member 315*a* and the first coacting member 315*b* that, when these members are in engagement, abut on each other are angular so that these members may not easily come out of engagement.

Figure 10:
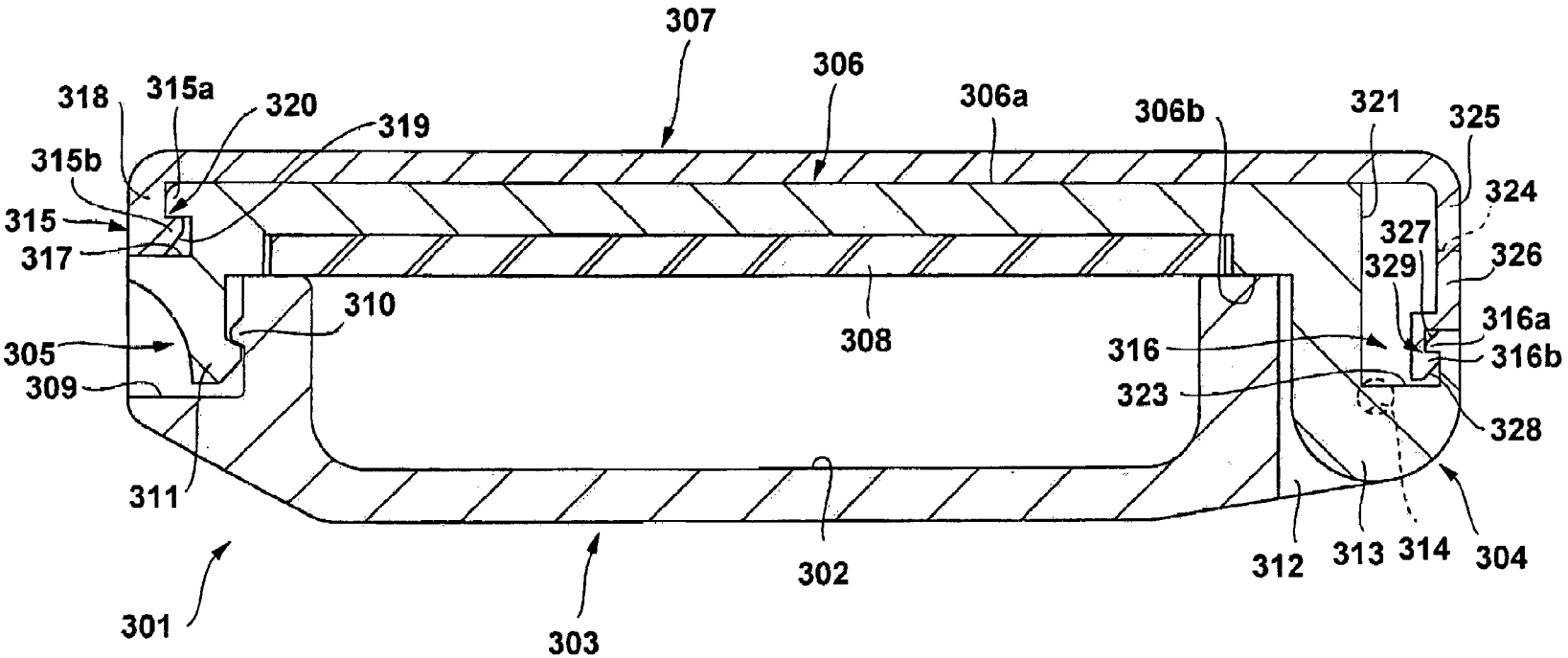
FIG. 10 is a side sectional view of a cosmetic container in accordance with a third preferred embodiment of the present invention.
Figure 11:
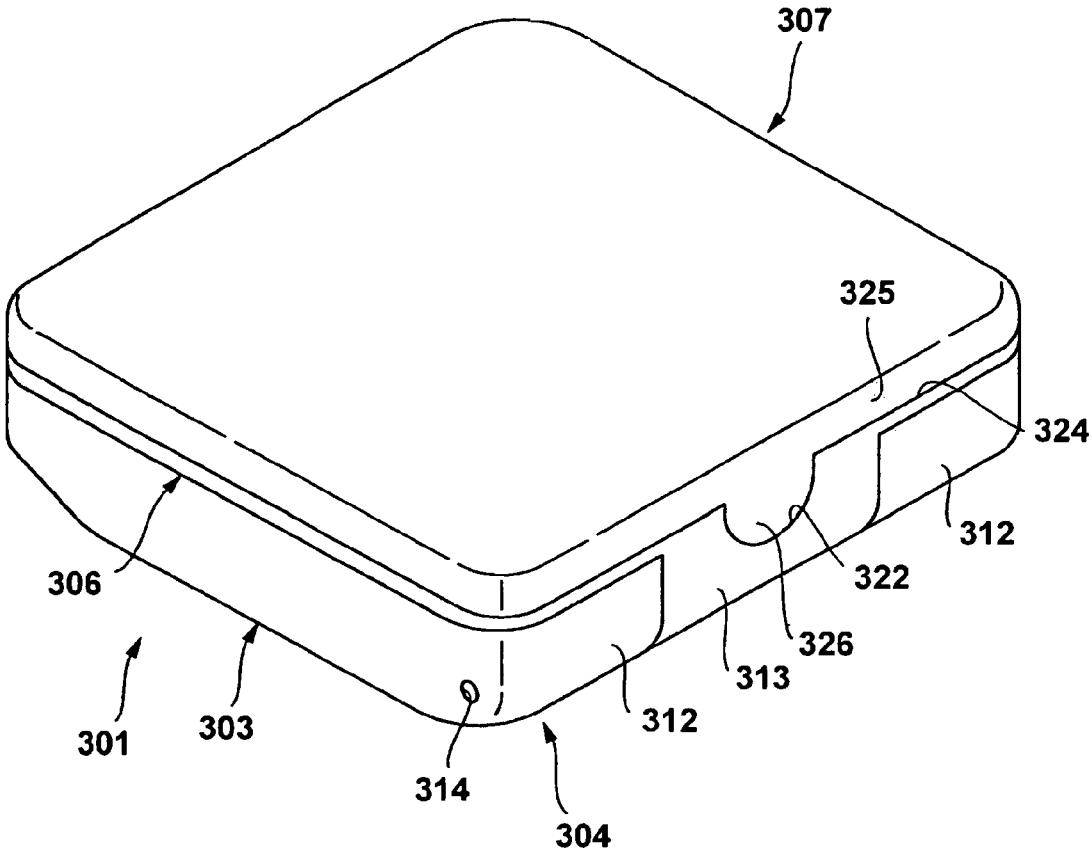
FIG. 11 is a perspective view of the cosmetic container of FIG. 10 as shown from behind.
Figure 12:
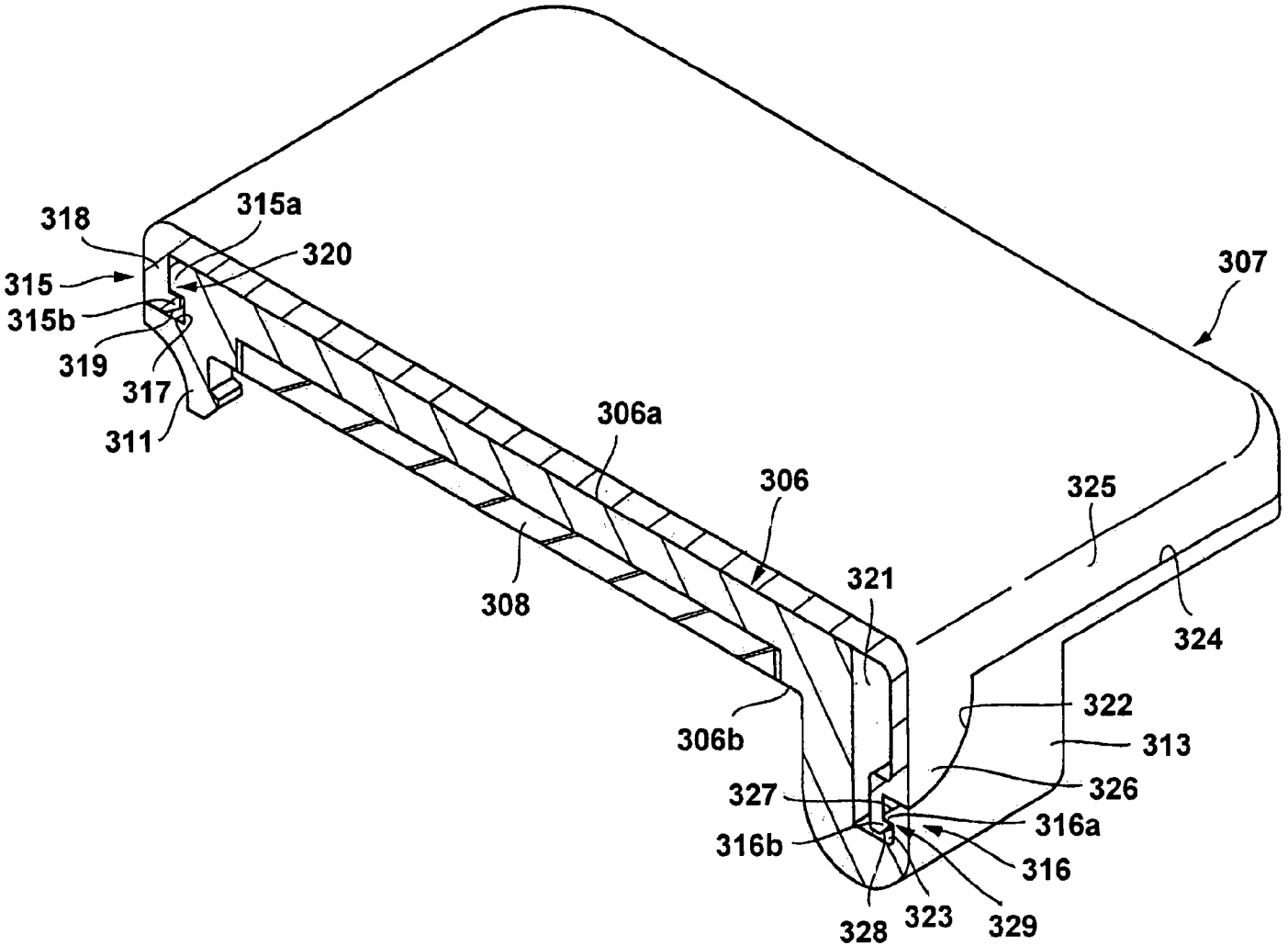
FIG. 12 is a fragmentary exploded perspective sectional view of the cosmetic container of FIG. 10.

Like the first engaging mechanism 315, the second engaging mechanism 316 adjacent to the hinge 304 also comprises a second engaging member 316*a* on the lid section 306, and a second coacting member 316*b* on the replaceable cover 307, both members engaging with each other. A recess 321 is formed in the outer surface 306*a* of the lid section 306. As shown in FIGS. 10 through 12, the recess 321 extends to a substantial depth from the center of the rear end of the lid section 306 to the hinge block 313 below so as to be open upward and rearward, thus a U-shaped opening 322 is formed in the rear wall of the hinge block 313, and a groove 323 is also formed below the opening 322. In this groove 323, the second engaging member 316*a* is formed at the lower end of the U-shaped opening 322 to project into the recess 321.

On the other hand, the entire width of the replaceable cover 307 adjacent to the hinge ends in a bent, downward extension 325 which extends toward the lid section 306 to be fitted onto a ledge 324 formed over the entire width of the lid section 306 adjacent to the hinge. From this downward extension 325, a resiliently deformable handle 326 further extends downwardly in a shape corresponding to the opening 322, and fits into this opening to conceal the recess 321. This handle 326 is provided at the lower end with the second coacting member 316*b*, which bends in an L-shape to face the second engaging member 316*a* and project into the recess 323 such that it may releasably engage the second engaging member 316*a*.

Also, when the replaceable cover 307 is fitted onto the lid section 306, the second coacting member 316*b* is pushed over the second engaging member 316*a* so that these members are releasably engaged with each other. As for the second engaging mechanism 316, the walls 327, 328 of the second engaging member 316*a* and the second coacting member 316*b* that, during the pushing process, come into contact with each other, are tapered to help the second coacting member to go smoothly over the second engaging member, while the corners 329 of the second engaging member 316*a* and the second coacting member 316*b* that, when these members are in engagement, abut on each other are angular so that these members may not easily come out of engagement.

Figure 13:
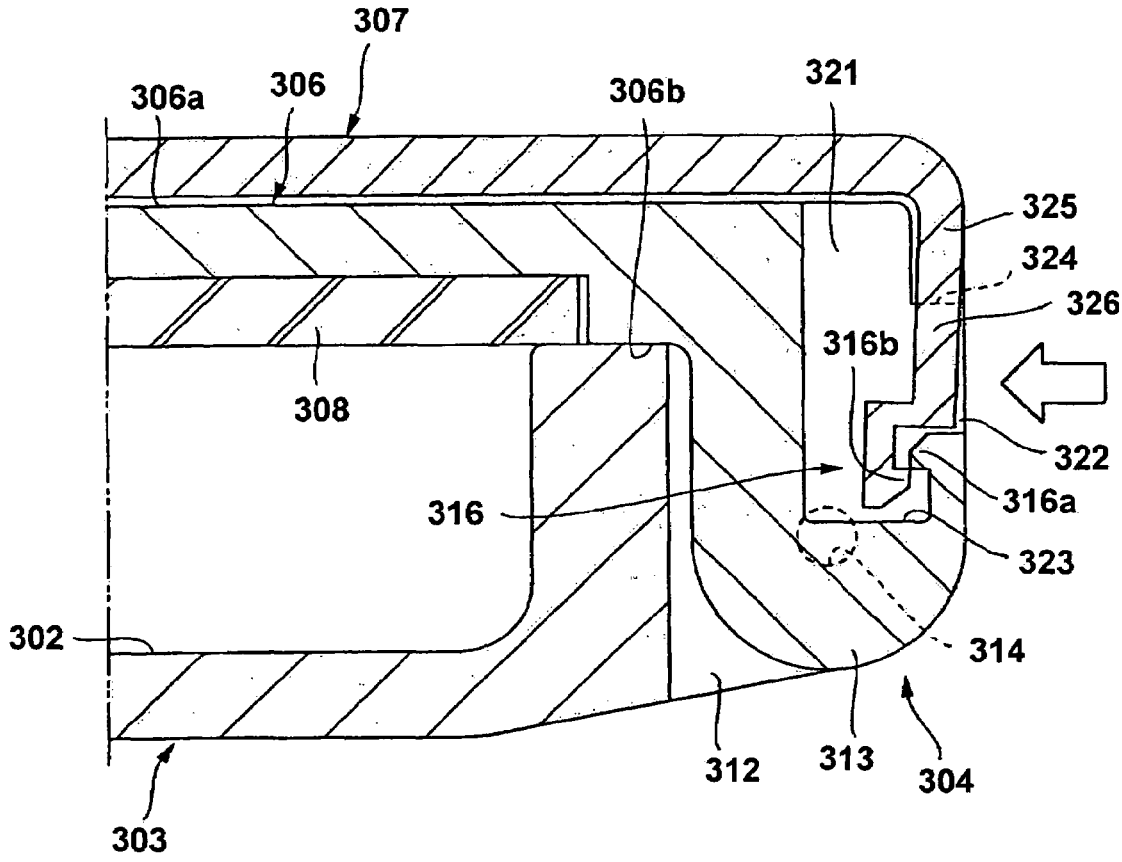
FIG. 13 is an enlarged sectional view of part adjacent to a hinge block of the cosmetic container of FIG. 10, showing the first stage in detaching a replaceable cover.
Figure 14:
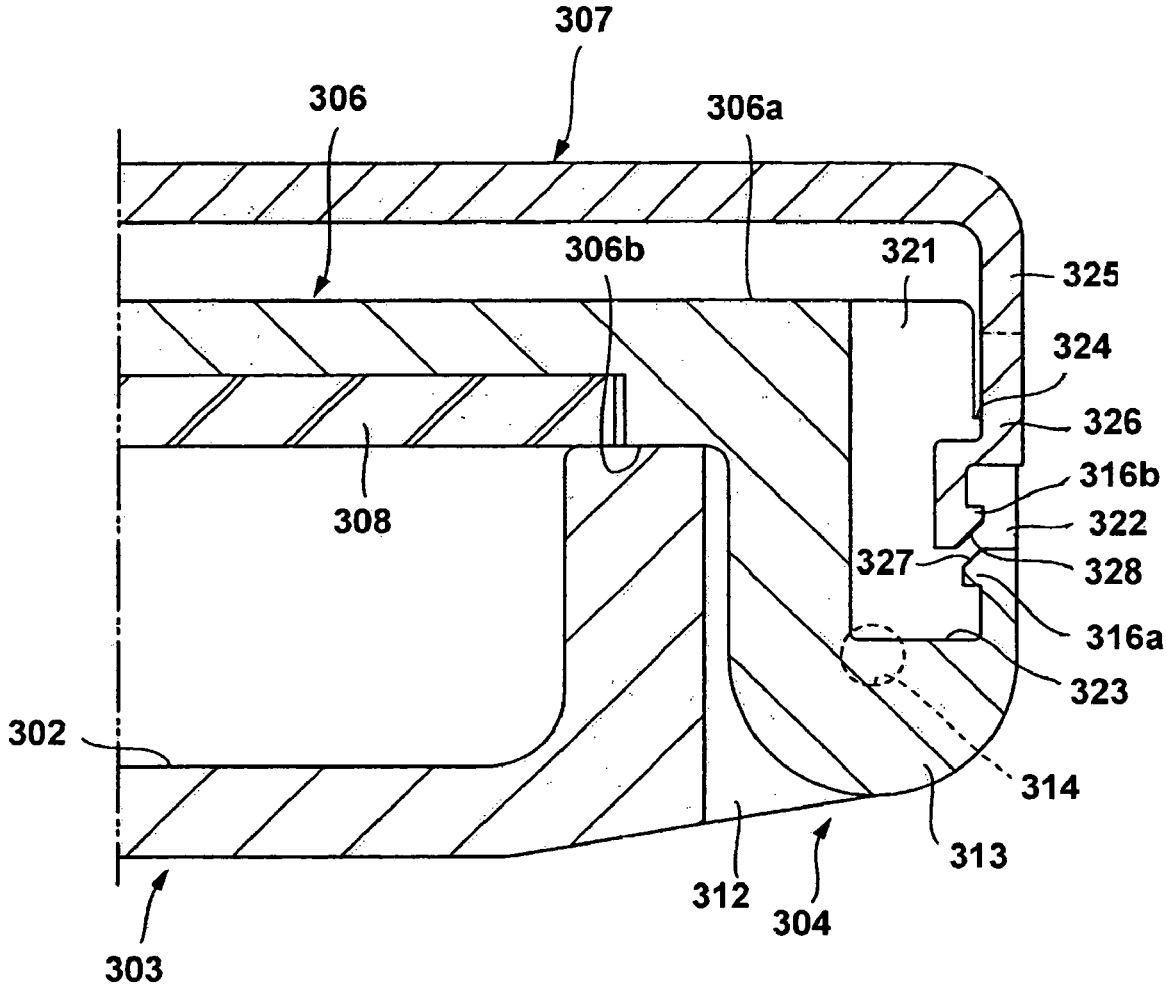
FIG. 14 is an enlarged sectional view of the part adjacent to the hinge block of the cosmetic container of FIG. 10, showing the last stage in detaching the replaceable cover.

In operation of the cosmetic container 301 according to the third embodiment of the present invention, when a user wishes to replace her replaceable cover 307 fitted on the lid section 306 with a new replaceable cover 307 of another design, the handle 326, which is fitted in the opening 322 of the hinge block 313, is pushed, as shown in FIGS. 13 and 14, toward the front of the cosmetic container 301, toward the inside of the recess 321.

When pushed, the handle 326 is resiliently deformed, thereby causing the second coacting member 316*b* to disengage from the second engaging member 316*a*, and then the replaceable cover 307 is raised and pulled away from the lid section 306. When the replaceable cover 307 is detached in this way from the lid section 306 by the disengagement of the second engaging mechanism 316, the first engaging member 315*a* and first coacting member 315*b* of the first engaging mechanism 315 can be disengaged from each other, and thus the replaceable cover 307 can be detached from the lid section 306.

Next, in order to mount a new replaceable cover 307 on the lid section 306, the side of the replaceable cover 307 where the second engaging mechanism 316 is disposed is pushed toward the lid section 306 with the first engaging mechanism 315 being in engagement, thereby causing the handle 326 to fit into the opening 322. The resilient deformation of the handle causes the second coacting member 316*b* to engage the second engaging member 316*a*. Hence, the new replaceable cover 307 can be mounted on the lid section 306.

As described above, since the cosmetic container 301 according to the third preferred embodiment of the present invention is provided with the replaceable cover 307 attached on, and replaceably covering, the lid section 306, the recess 321 formed in the outer surface 306*a* of the lid section 306, the second engaging member 316*a* formed inside the recess 321, the resiliently deformable handle 326 formed in the replaceable cover 307 to conceal the recess 321, and the second coacting member 316*b*, formed on the handle 326, for releasably engaging the second engaging member 316*a* so as to be disengaged from the second engaging member 316*a* by the resilient deformation of the handle 326, a user can freely change the external decorative appearance of the cosmetic container 301 originally affixed by a manufacturer to a preferable one, which can arouse consumer interest for sales increase.

Further, since the decorative part may be undetachably, integrally formed with the replaceable cover 307 in the same manner as conventional lid sections, it is not possible that the decorative part even partially peels off or come off of the replaceable cover 307, so the cosmetic container 301 according to the present invention can stand comparison, in quality and upscale appearance, with conventional ones. Further, the first engaging mechanism 315 and second engaging mechanism 316 are provided between the replaceable cover 307 and lid section 306 for the releasable engagement between these, so the replaceable cover 307 can be replaced easily by the engagement and disengagement of these engaging mechanisms 315, 316.

Furthermore, in this embodiment, the replaceable cover 307 is formed to cover the outer surface 306*a* of the lid section 306, which is provided with the hinge block 313, rotatably attached to the container section 303, for opening and closing the cosmetic container 301, the recess 321 is formed to extend from the lid section 306 to the hinge block 313, and the handle 326 is fitted into the opening 322 of the hinge block 313, so the hinge block 313 can be used as the space in which the recess 321, second engaging member 316*a* and handle 326 are formed for mounting the replaceable cover 307 on, and detaching it from, the lid section 306, thereby preventing enlargement of the outer dimensions of the cosmetic container 301.

Further, the structure that the recess 321 is concealed by the handle 326 renders the external appearance of the present cosmetic container 301 aesthetically pleasing. Further, the handle 326 for the engagement and disengagement of the second coacting member 316*b* is resiliently deformable, which can achieve enhanced ease of use for the engagement and disengagement of the second engaging mechanism 316.

Figure 15:
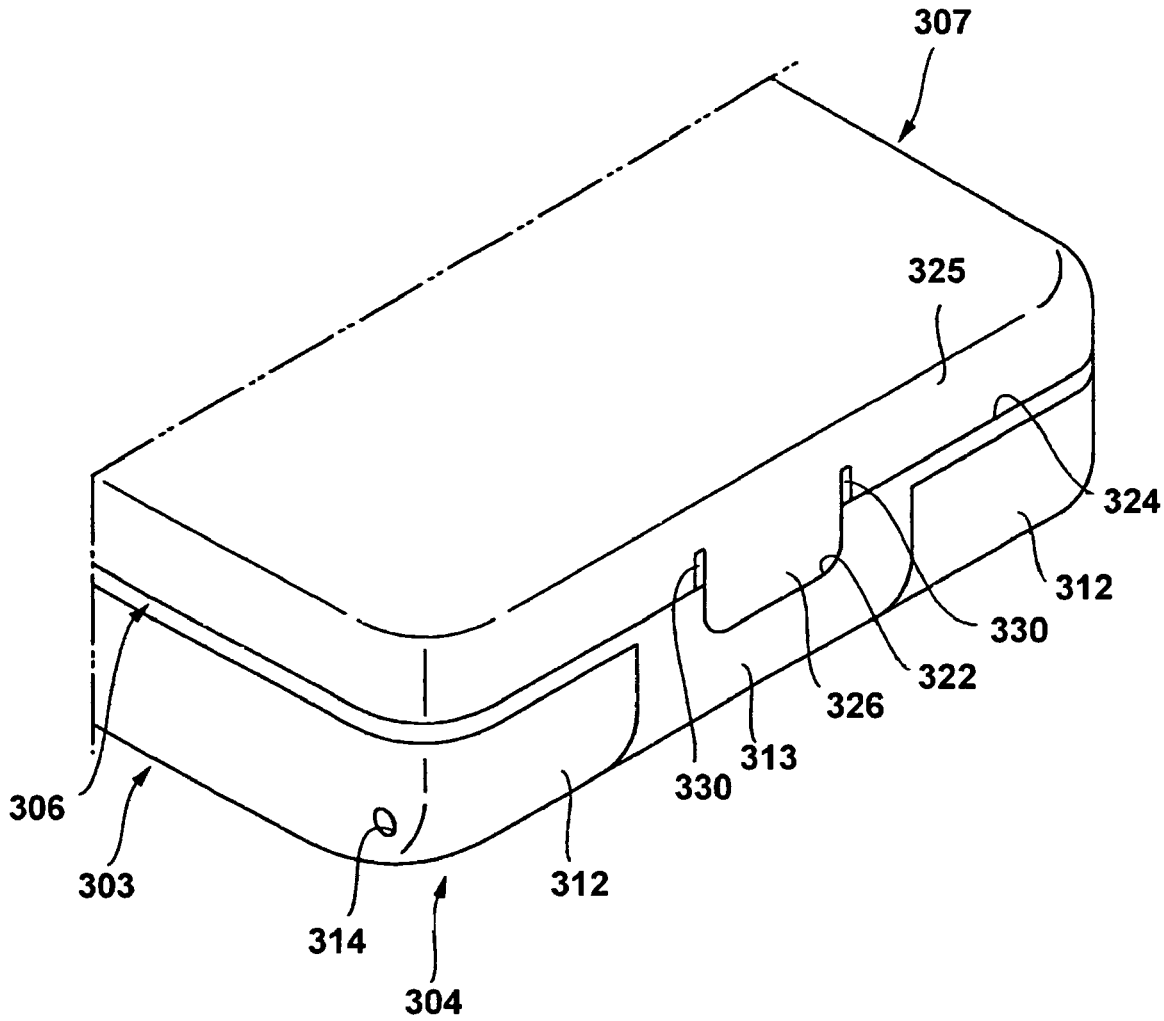
FIG. 15 is a perspective view, as seen from behind, of a variant of the cosmetic container in accordance with the third preferred embodiment of the present invention.

FIG. 15 shows a variant of the above third preferred embodiment. In this variant, in order to realize a shorter downward extension for the handle 326 extending from the replaceable cover 307, a pair of slits 330, separated by the handle 326, are formed in the replaceable cover 307. Where, for example, the thickness of the container section 303 is small, and therefore the opening 322 of the hinge block 313 is not sufficiently large, the slits 330, formed as described above, can make up for the short downward extension of the handle 326 because they impart extra resilience for the resilient deformation of the handle 326. Needless to say, this variant has the same effects as the above embodiment.

Although the description has been given about the third preferred embodiment of the structure in which the replaceable cover 307 is detachably attached on, and replaceably covers, the lid section 306, the replaceable cover 307 may be attached on the container section 303. In this case, the recess 321 and second engaging member 316*a* may be provided in the hinge block 312.

Although the invention has been described about the third preferred embodiment of the structure in which the cosmetic container 301 is provided with the hinge 304 and latch mechanism 305, it is not limited, needless to say, to this structure, and may be applied to various containers in which the lid section 306 is engaged with, and disengaged from, the container section 303 by a threaded structure or radial engagement structure.

INDUSTRIAL APPLICABILITY

As can be seen from the above detailed description about the preferred embodiments of the present invention, the cosmetic container of the present invention comprises a container section, a lid section for opening and closing the cosmetic container, and one or two replaceable covers detachably attached on, and replaceably covering, one or both of the lid section and the container section so that it can satisfy the demand that the decorative part should not even partially peel off or come off of the container section or lid section, and can give a user greater freedom of choice in the selection of its outer appearance.

What is claimed is:

1. A cosmetic container, comprising:

a container section provided with a cosmetic storage portion, a lid section pivoted on a hinge at one end of said container section for vertical rotation for opening and closing said container section and releasably engaging the other end of said container section via a latch mechanism so as to retain said container section in a closed state, said lid section having a mirror attached on the undersurface thereof, a replaceable decorative cover detachably attached on top of said lid section so as to replaceably cover the upper surface of said lid section, said hinge comprising a pair of hinge pieces projecting from the end of said container section, a hinge block extending downward from the end of said lid section between said hinge pieces, and a hinge pin pivotably connecting said hinge pieces and said hinge block, a first engaging mechanism and a second engaging mechanism being provided between said replaceable cover and said lid section so as to be releasably engaged with each other, said first engaging mechanism being provided adjacent to said latch mechanism, and said second engaging mechanism being provided adjacent to said hinge, said hinge block having a through-hole extending vertically through said lid section toward said replaceable cover fitted on said lid section and a dent formed on the side of said hinge block facing said mirror so as to surround said through-hole, said second engaging mechanism having a handle extending downwardly from said replaceable cover through said through-hole and said lid section and exposing in said dent, said handle having a length sufficient to be resiliently deformable toward said dent and being provided with means releasably engaging with said lid section, said engaging means being released when said handle is pushed toward said dent and said replaceable cover being removable from said lid section.

* * * * *